US005353446A

United States Patent [19]

Baranowski

[11] Patent Number: 5,353,446

[45] Date of Patent: Oct. 11, 1994

[54] MEANS FOR FACILITATING THE ENTRY AND EXIT OF A PERSON IN A WHEELCHAIR INTO AND OUT OF A POOL OR BODY OF WATER

[76] Inventor: Edwin M. Baranowski, 75 Marrus Dr., Gahanna, Ohio 43230

[21] Appl. No.: 132,098

[22] Filed: Oct. 5, 1993

[51] Int. Cl.[5] ..... E04H 4/14

[52] U.S. Cl. ..... 4/496; 188/32

[58] Field of Search ..... 4/494, 496, 504, 560.1, 4/604; 188/32; 193/41; 280/304.1

[56] References Cited

U.S. PATENT DOCUMENTS

| | | | |
|---|---|---|---|
| 2,719,610 | 10/1955 | Allison | 188/32 |
| 2,956,646 | 10/1960 | Isgren et al. | 188/32 |
| 3,811,536 | 5/1974 | Haynes | 188/32 |
| 4,283,803 | 8/1981 | Krumbeck | 4/496 |
| 4,872,534 | 10/1989 | Corsi et al | 188/32 |
| 4,911,270 | 3/1990 | Hudson | 188/32 |
| 4,998,305 | 3/1991 | Davis | 4/604 |

*Primary Examiner*—Robert M. Fetsuga

[57] ABSTRACT

A device for facilitating the assisted entry and exit of a person in a wheelchair (a) from the wheelchair into a body of water and (b) out of the water back into the wheelchair is disclosed in which a platform support has two forward sections that extend at least partially over the water and receive thereon a front wheel of each respective side of the wheelchair, such that the positional relationship of the wheelchair with respect to the water, when the wheelchair is disposed on the platform, is one in which at least a front portion of the front edge of the seat of the wheelchair, in a vertical orientation, is disposed over the water surface, and the movement of the person in the wheelchair, upon the person's movement from the wheelchair entering into the pool, and exiting from the pool back into the wheelchair, is an essentially direct vertical movement with respect to the water, uninterrupted by a physical barrier. The platform is adaptable to retrofit or built-in construction, may be an add-on appliance device, may be fabricated in the form of a flexible mat, solid plate, or other variation. The device is useful with pools, ocean or freshwater docks, boat platforms and other environments where wheelchair access to water is desirable.

10 Claims, 2 Drawing Sheets

MEANS FOR FACILITATING THE ENTRY AND EXIT OF A PERSON IN A WHEELCHAIR INTO AND OUT OF A POOL OR BODY OF WATER

Swimming and water therapy are considered optimum forms of recreation, exercise and conditioning for wheelchair bound persons. Oftentimes, however, access to a pool or entry into a body of water is not easy. The prior art has suggested the use of hoists, basket lifts, water powered seat lifts and other cumbersome, complicated and expensive devices, to move a person from a wheelchair into a pool and to remove that person from the pool and return the person to the wheelchair. Most of these devices and techniques require, in some form, that the person in the wheelchair be assisted and that an assistant provide some role in the placement and use of a mechanical device.

Without devices that place a person directly into a pool, or other assistance, the wheelchair challenged person usually drops from the wheelchair, down to the pool deck, and then shifts laterally or forwardly, into the pool water. In anecdotal or rare instances, that person may drop (or dive) directly from the wheelchair seat into the pool. In many cases, the difficulty of the effort may be discouraging, or dangerous. The device used, or its perception, may be too complicated, prohibitive, or expensive.

An object of the present invention is to facilitate pool access, to provide a access means for wheelchair challenged persons having a design that is retrofitable to existing pools and that can be adapted to new construction, so that wheelchair access to pools and water sporting activities can be easily and inexpensively provided and routinely used. The access means is likely to find use in public, private club, institutional, hotel and resort and personal swimming and therapy pools. As used herein "pool" refers to conventional pools, however, it is evident that the access device herein can be adapted for use at a swimming area of a lake or ocean, such as with a appropriately configured section of a dock, or the swimming or diving platform of a boat. Hence, the pool access contemplated extends to an environment encountered by a wheelchair challenged person requiring water entry, and exit, for sport, therapy or other purpose.

These and other objects and achievements of the invention are more clearly explained with reference to the following description taken in conjunction with the drawings in which.

Figure 1:
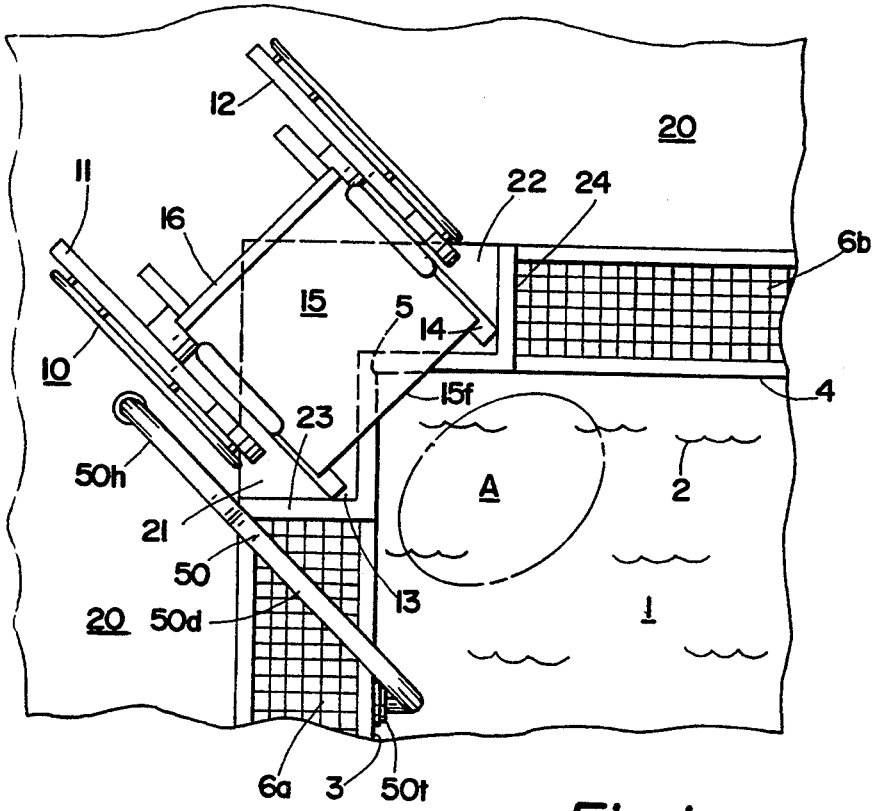
FIG. 1 is a top view of a wheelchair positioned on a platform of the invention at a pool corner.

The invention provides a platform for facilitating the entry and exit of a person in a four wheeled wheelchair (a) from the wheelchair and into the pool and (b) out of the pool back into the wheelchair. In the view shown in FIG. 1, the wheelchair 10 is disposed at a side corner of the pool, typically on the pool deck 20. With reference to the pool and wheelchair shown in the figures, a typical pool includes a volume of water 1 having a surface 2 contained within a closed construction, shown in FIG. 1 as rectangular, having sides 3 and 4 meeting in a corner at 5. Some pools have a wave or splash gutter, such as shown at *6a* and *6b*, slightly above the water surface 2 and below the pool deck 20 . Wheelchairs are known and usually include large diameter rear wheels 11 and 12, smaller front wheels 13 and 14, seat 15 and back 16. In a typical chair the seat is about 16 to 18 inches (40 to 50 centimeters) wide. The front wheels of the chair are spaced apart about 19.5 inches (50 centimeters). Because chairs differ, these "typical" dimensions vary.

The platform aligns the forward edge of the seat of the wheelchair in a perpendicular relationship with the surface of the water in the pool, such that the forward seat edge extends a distance laterally over the water surface away from the pool side or sides. In this relationship, movement of the person in the wheelchair, upon the person's front and down movement from the seat of the wheelchair, entering into the pool, and exiting from the pool back into the seat of the wheelchair, is an essentially horizontal forward movement from the seat and a direct vertical movement into the water, uninterrupted by a physical barrier of a pool side.

The platform provides a support which is secured, or otherwise formed at a corner or side of the pool perimeter. The platform provides two forwardly extending sections 21 and 22, each of which receives thereon the front wheels 13 and 14 of each side of the wheelchair. (As contemporaneously considered a "wheelchair" includes four wheels, arranged in two parallel axes, the front wheels being small and the rear wheels being large. Historically, this configuration is the opposite. Wheel configurations appear to be arbitrary.) The forward sections are disposed with respect to water in the pool such that, when the wheelchair rests thereon, at least a portion of the seat of the wheelchair, measured from the front edge thereof; is disposed vertically with respect to the water surface, a distance away from the pool side[s].

A pool corner is typically square, however a "corner," as contemplated herein may include an obtuse, acute, rounded, or polygonal sectioned joinder of pool sides. In any such corner configuration, the stated vertical relationship of the wheelchair seat and water surface as described above may be provided.

The platform is a plane surface parallel to the deck and water surfaces, and is accessible to the wheelchair without encumbrance. As noted, the platform sections 21 and 22 are capable of receiving and supporting thereon the front wheels 13 and 14 of the chair so that the seat 15 of the wheelchair is in a "normal" essentially parallel relationship with the surface of the water. With respect to the perpendicular relationship of forward edge **15*f* of the seat to the water, however, the seat edge extends laterally a distance extending over the water surface, a distance from the pool side and corner. The platform includes positioning and stop means for the front wheels as are shown at 23 and 24, Such means extend vertically upwards (about 40 to 75 millimeters (about 1.5 to 3 inches are sufficient) from the platform surface and may be horizontally "v" shaped with one side positioned in alignment with the pool side, and the other side extending rearwardly and perpendicularly therefrom, as shown in FIG. 1. Alternatively, the stop means may be positioned parallel to the wheel axis of the chair, as shown at 38 in FIG. 2, or, as shown at a corner in FIG. 1**, angled 45 degrees with respect to the pool side[s].

Figure 2:
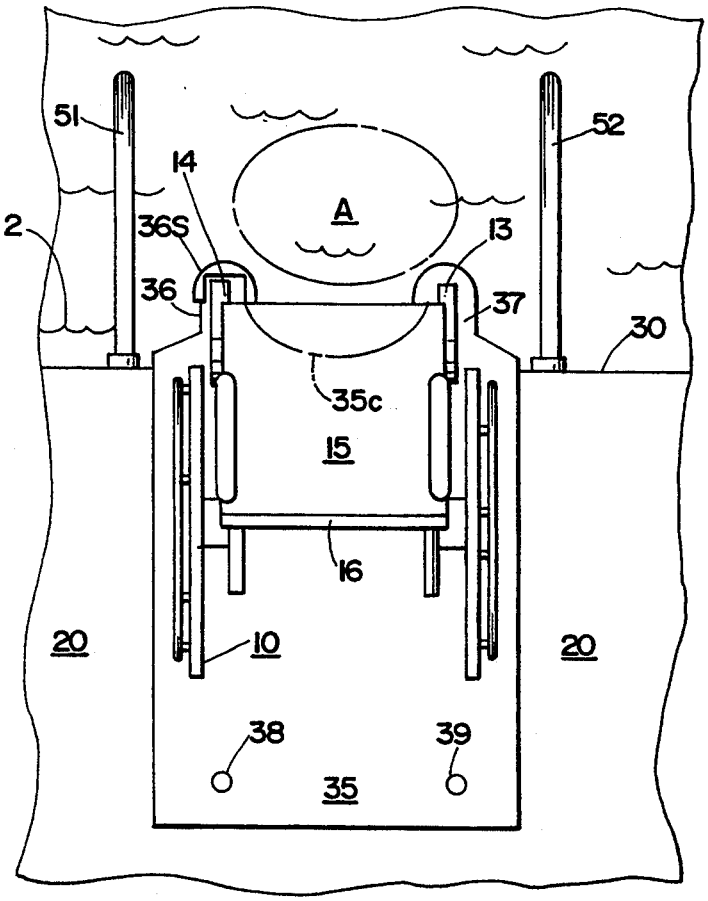
FIG. 2 is a top view of an alternative embodiment in which a wheelchair is positioned on a platform of the invention at a pool side.

At a curved or linear side of a pool, a platform may be provided as shown in FIG. 2. Here, the platform 35 has extending sections 36 and 37 which project from the pool side 30 and receive thereon the front wheels 14 and 15 of each side of the wheelchair. The front wheel receiving sections can be intrinsically built, or formed into, a pool side, or may be part of the design of a rigid planar plate having such a form, that is secured permanently or temporarily to the deck, such as by fasteners at 38 and 39. The front wheel receiving sections 36 and 37 include positioning and stop means for the front wheels of the chair. The sections may be sloped down or up with respect to the deck or water surface, depending on preference. In FIG. 2 a stop means is shown to be a rounded or cup shape 36*s*, formed at the end of the section; a corresponding means is included at the other side section. The front section of the platform 35*c*, between the wheel receiving sides, is cut out rearwardly as shown at 35*c*, such that in vertical relationship with the forward edge of the seat 15*f*, the platform does not project beyond the forward edge. The depth of the cut out from the seat front edge preferably extends backwardly 100 or more millimeters (about four to ten or more inches), comparable to the height of the triangle formed by the pool sides and the (45 millimeters or 18 inches) seat edge when a platform is at a corner installation (See FIG. 1.). The apex of the triangle is corner 5, the base and sides are determined by the intersection of line 15*f* with lines 3 and 4. A vertically triangular or other support extending from the pool side, or a support from the bottom, may be used to reinforce the front wheel receiving sections of the platform depending on design, use and material factors.

As noted, the platform includes barrier means for preventing movement of the chair wheels to prevent the chair from rolling into the water. Whenever the device is used, the chair should be braked. If the brakes fail, the barriers prevent the chair, and/or person therein from falling into the pool. Typically this barrier will include a frontal, and optionally side, lip extending upwards from the surface of the platform about 25 to 75 or more millimeters (about one to three inches). A side lip parallel to the sides of the chair and its wheels assists in aligning the wheelchair in the center of the device, or in the center of the pool corner, if the platform is so installed, so that the proper positioning of the wheelchair is achieved. The "v" shape of the corner platform of FIG. 1, and the separated sections of the side and/or corner embodiment of FIG. 2 makes the device essentially self-aligning to place the chair in a proper position,

EXAMPLE 1

In use, the wheelchair, including the person in the wheelchair, is positioned on the platform as shown in the top views of FIGS. 1 and 2. In an example entrance into the pool, assistants grasp the persons' arms or vice versa on each side, the person moves forward horizontally from the chair seat, and, when the seat is cleared, goes vertically down into the pool, at approximately the access area A shown in FIGS. 1 and 2. Entrance into the pool is direct and unincumbered by interference from the pool side(s). Depending on the depth of the water, the body may become fully vertically extended in this process (if the platform is installed at the deep end or side of the pool) and the pool deck or side(s) do not interfere with the body limbs. It is preferred in the use of the invention that the device be installed at a deep end of the pool so that a complete vertically extended entrance into the pool in area A is achieved. No appliance, powered or otherwise is needed. The person is not subject to a "two step" entry involving a first drop to the pool deck, risking a "bottom" hit to the buttocks, and next, into the pool. Nor is the person subject to back scraping at the pool corner, side or edge. The person's legs, knees, hips and ankle joints do not tangle, as occurs in a two step deck entry. The person from the wheelchair, with reference to FIG. 2 may guide him or her self by grasping or resting with hands at either pool side 3 or 4. The relationship that the platform configuration creates with respect to the wheelchair seat, and the water, insures that the pool side and deck barrier is avoided. Exit from the pool is self evidently the reverse process.

EXAMPLE 2

Figure 4A:
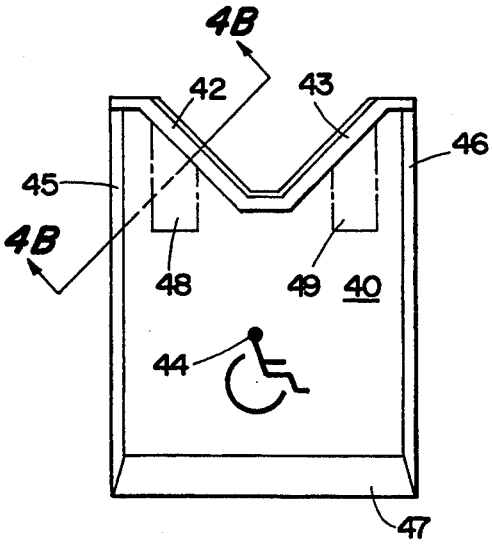
FIGS. 4A, 4B and 4C are respectively top, front cross-section and side views of a solid plate, or flexible "mat," configuration for a platform.
Figure 4B:
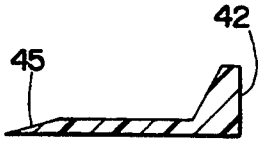
Figure 4C:
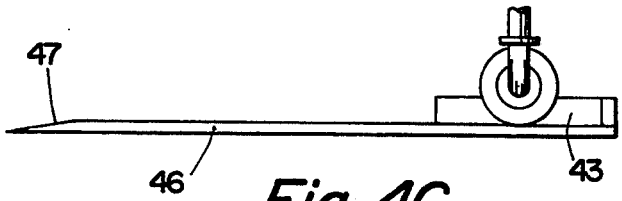

FIGS. 4A, 4B and 4C illustrate a variation of the device which conveniently provides a properly configured front wheel barrier intrinsically formed into a mat or plate. Such a variation, as a mat, may be formed of a suitable polymer composite such as a filled rubber or fiber reinforced composition comparable to an automobile tire material to provide an inexpensive, slip-resistant, flexible and easily deployed "mat" that can be positioned at a pool corner. The mat 40, in FIG. 4A, may have inscribed thereon or molded therein use instructions for the device, the conventional wheelchair access logo, a municipality name or insignia, a hotel coat of arms, a country club logo, advertising or any other message or decoration as shown at 44. An approximate mat size is about 1.2 by 1.5 meters (about 48 by 60 inches) wide and long by about 15 millimeters (0.5 inch) thick, with a front barrier 42 and 43 about 70 to 100 millimeters (3 to 4 inches) high. The sides of the mat may be slightly tapered downward to the pool deck at sections 45 and 46 to minimize tripping by walking persons over the mat and the rear section of the mat 47 may be more gradually tapered to facilitate placement of the chair on the mat. The areas for placement of the front wheels of the chair are shown at 48 and 49. In addition to providing a platform, the mat is a readily visible "invitation" that the pool is accessible and establishes an access "zone" at the pool which should be respected by other pool users. If made of a flexible enough material, the mat can be rolled up and stored away when not in use.

The mat may also be made from solid plate material such as aluminum, stainless steel, hard polymer compositions and the like, dependent on material availability, use considerations and the like.

Figure 3:
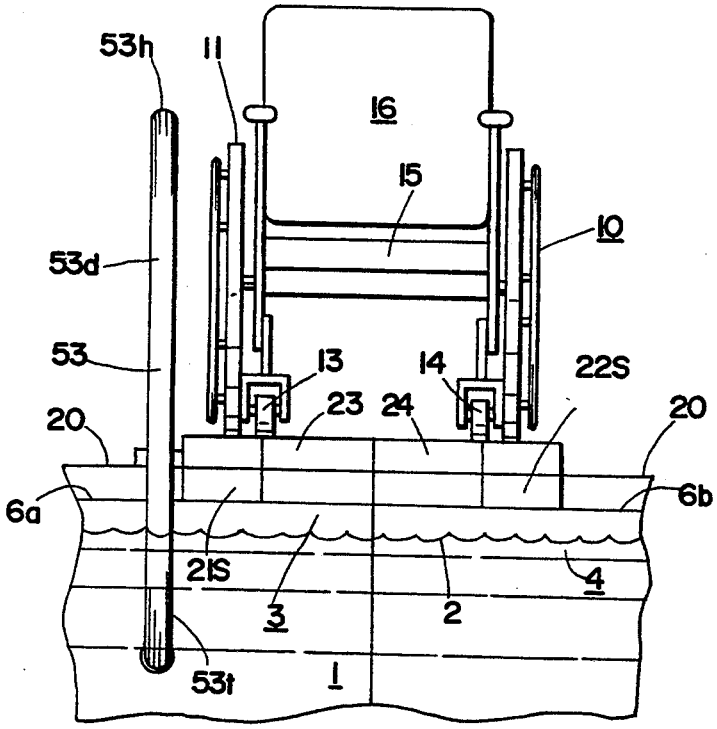
FIG. 3 is a front view, facing the chair from within the pool, of the wheelchair and platform configuration of FIG. 1.
Figure 5:
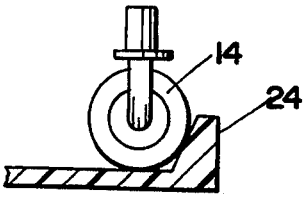
FIG. 5 illustrates a typical front barrier preventing movement of the wheelchair.

A conventional pool rail or specially adapted rails may be installed at either, or both, sides of the platform, as shown at 50, 51, 52 and 53 in FIGS. 1, 2 and 3.

Depending on the physical capabilities of the person in the wheelchair, the rails may be used by the person in entry and egress from the pool, and varying degrees of assistance may or may not be required. For example, in FIGS. 1 and 3, the rails are attached to the pool deck 20 and extend horizontally in sections 50*h* and 53*h* at the approximate level of the chair arms. The rails then slope downwardly in sections 50*d* and 53*d* towards the water surface, and have terminating sections 50*t* and 53*t* in the pool. In FIG. 2, rails 51 and 52 are installed at approximately the water level to provide a definition of the wheelchair access area of the pool, and to guide and support entry and exit.

Adaptations of the device are dependent on pool configuration. An advantage of the device is that it may be installed at a location of the pool where it unobtrusively provides wheelchair access to a private section of the pool and does not interfere with conventional stair or ladder access to the pool.

If a pool has a wave gutter above or at the water level, beneath the level of the pool deck, a vertical support extending from the gutter or deck level, shown at 21*s* and 22*s* in the front view of FIG. 3, should preferably be provided between the gutter surface and the front wheel platform sections. The device need not be installed at deck level. A sloped, downwardly or upwardly extending ramp may position the wheelchair seat at, above, adjacent or below the water surface, in accordance with the present specification, and allow assisted or non-assisted access to the pool depending on design parameters, the ability or preference of the wheelchair challenged person.

Thus, the device provides means for facilitating the assisted entry and exit of a person in a wheelchair into and out of water in which a platform support has two forward sections that receive thereon a front wheel of each respective side of the wheelchair, such that the movement of the person in the wheelchair, upon the person's movement from the wheelchair entering into the pool, and exiting from the pool back into the wheelchair, is an essentially direct vertical movement with respect to the water, uninterrupted by a physical barrier. The platform is adaptable to retrofit or built-in construction, may be an add-on appliance device, may be fabricated in the form of a flexible mat or a solid plate, or other variation. The device is useful in pools, ocean or freshwater docks, boat platforms and other environments where wheelchair access is desirable.

What is claimed is:

1. A platform for facilitating the entry and exit of a person in a wheelchair (a) from the wheelchair and into a pool and (b) out of the pool back into the wheelchair, the wheelchair including a pair of front and rear wheels and a seat, the pool including substantially vertical sides and a substantially horizontal deck defining an upper edge, said platform comprising:

a platform support adapted to be secured to the pool deck adjacent the upper edge, said platform having two spaced apart front sections defining an opening therebetween, each section capable of receiving a respective one of the front wheels of the wheelchair, such that when the wheelchair is disposed thereon, at least a portion of the front edge of the seat of the wheelchair can be positioned, vertically with respect to the water surface, over the water and spaced from the pool edge, said platform including means for preventing movement of the wheelchair beyond a front edge portion of the front sections, whereby movement of the person from the seat of the wheelchair entering into the pool, and exiting from the pool back into the seat of the wheelchair, is an essentially direct vertical movement with respect to the water facilitated by the opening between the front sections.

2. The platform of claim 1 wherein the pool includes a corner defined by the joinder of the sides of the pool, in which the front sections are positioned at respective sides of the corner.

3. A platform in accordance with claim 1 wherein the pool includes a wave gutter disposed between the water level and the upper edge, said platform comprising support means for supporting the front sections on the wave gutter.

4. A platform of claim 1 in which the pool is of sufficient depth such that a person in a wheelchair may accomplish a fully extended body entrance from the wheelchair into the pool.

5. The platform of claim 1 wherein the platform is a planar plate having intrinsically formed therein the two front sections which receive the front wheels of the wheelchair.

6. The platform of claim 1 wherein the platform is a flexible mat formed from a polymeric composition and in which the pool deck provides support for the mat.

7. The platform of claim 1 wherein one of the pool sides is linear, in which the front sections are positioned essentially perpendicular to the linear side.

8. Means for facilitating the assisted entry and exit of a person in a wheelchair (a) from the wheelchair into a pool and (b) out of the pool back into the wheelchair, the pool being adjacent a substantially horizontal deck disposed above a pool water level and defining an upper edge, said entry facilitating means comprising:

a wheelchair including a seat for the person and a pair of front and rear wheels, a platform support adapted to be secured to the pool deck adjacent the upper edge, said platform having two spaced apart front sections defining an opening therebetween, each section capable of receiving thereon a front wheel of each respective side of the wheelchair, such that the positional relationship of the wheelchair with respect to the water, when the wheelchair is disposed on the platform with the front wheels on the forward sections, is one in which at least a front portion of the front edge of the seat of the wheelchair, in a vertical orientation, is disposed over the water surface, spaced horizontally from the upper edge, said platform including means for preventing movement of the wheelchair beyond a front edge portion of the front sections, whereby movement of the person from the seat of the wheelchair entering into the pool, and exiting from the pool back into the seat of the wheelchair, is an essentially direct vertical movement with respect to the water facilitated by the opening between the front sections.

9. The means of claim 8 including at least one handrail adapted to be secured to a support proximate to the pool, the handrail being adjacent to at least a front section of the platform support at an outer side thereof at a position where the handrail is capable of being grasped by the person.

10. The platform of claim 1 in combination with at least one handrail adapted to be secured to a support proximate to the pool, the handrail being adjacent to at least a front section of the platform at an outer side thereof at a position where the handrail is capable of being grasped by the person.

* * * * *